US007934899B2

(12) United States Patent
Downing

(10) Patent No.: US 7,934,899 B2
(45) Date of Patent: May 3, 2011

(54) BUCKET ATTACHMENT FOR LOADER

(76) Inventor: Bruce Downing, Plano, TX (US)

( * ) Notice: Subject to any disclaimer, the term of this patent is extended or adjusted under 35 U.S.C. 154(b) by 297 days.

(21) Appl. No.: 11/778,459

(22) Filed: Jul. 16, 2007

(65) Prior Publication Data

US 2007/0253802 A1 Nov. 1, 2007

Related U.S. Application Data

(63) Continuation-in-part of application No. 11/187,135, filed on Jul. 22, 2005, now abandoned, which is a continuation-in-part of application No. 10/642,411, filed on Aug. 15, 2003, now abandoned.

(51) Int. Cl.
*E02F 3/00* (2006.01)

(52) U.S. Cl. ..... 414/722; 37/411

(58) Field of Classification Search ..... 414/722, 414/723, 724; 37/403, 411, 468
See application file for complete search history.

(56) References Cited

U.S. PATENT DOCUMENTS

| | | | | |
|---|---|---|---|---|
| 4,476,641 | A * | 10/1984 | Ballinger | 37/444 |
| 5,281,073 | A * | 1/1994 | Gesuale | 414/421 |
| 5,535,533 | A * | 7/1996 | Romanchok | 37/403 |
| 5,885,053 | A * | 3/1999 | Deye | 414/722 |
| 5,921,743 | A * | 7/1999 | Slagter | 414/722 |
| 5,938,398 | A * | 8/1999 | Brown | 414/607 |
| 6,908,089 | B1 * | 6/2005 | Stark et al. | 280/47.31 |
| 6,969,226 | B2 * | 11/2005 | Raley | 414/725 |

* cited by examiner

*Primary Examiner* — Donald Underwood
(74) *Attorney, Agent, or Firm* — Holland & Hart LLP

(57) ABSTRACT

An attachment useful with a mobile platform is provided for containing and selectively pouring flowable materials. The attachment has an elongated spout extending outwardly and upwardly from a forward wall of the attachment. Rear and side splash guards may be provided to help contain flowable materials within the attachment. Side walls of the attachment may be angled from front to rear. Tabs may be positioned to extend upwardly from a forward wall to assist in directing flowable material into the spout

17 Claims, 4 Drawing Sheets

BUCKET ATTACHMENT FOR LOADER

CROSS-REFERENCE TO RELATED APPLICATION

The invention is a continuation in part of, is related to and claims priority from a co-pending U.S. patent application Ser. No. 11/187,135 entitled BUCKET ATTACHMENT FOR LOADER by Bruce Downing, filed Jul. 22, 2005 and abandoned U.S. patent application 10/642,411 entitled BUCKET ATTACHMENT FOR LOADER by Bruce Downing, filed Aug. 15, 2003.

BACKGROUND

A wide array of mobile platforms are used in the construction industry, such as skid-steer loaders, wheel steer loaders, track loaders, compact track loaders, and the like. Such mobile platforms are popular with construction and earth excavation professionals because they offer a low-maintenance and low-cost way to quickly and powerfully perform projects which are not large enough to warrant the use of larger, more expensive construction equipment.

One distinguishing feature of smaller loaders is that they have systems that are used to couple attachments to the loader. For example, some loaders use skids (the parallel "fingers" on the front portion of a loader). Skids are often seen in warehouse settings sliding underneath a pallet so that the pallet may be lifted and moved. Skids may operate in horizontal or vertical configurations depending on the type of loader and its use. Other loaders use other coupling means, such as the Bobcat® quick-connect system.

Many loader attachments of various types are used in the construction industry. These attachments allow the loader to accomplish a specific application(s). One example of such an attachment is a digging bucket, which handles dirt and other materials. There are many application specific buckets, such as low profile buckets, light material buckets, fertilizer buckets, and construction-industrial buckets. However, there exist needs for additional bucket attachments to offer loader operators more control in various loader operations. For example, the prior art lacks bucket-style attachments that may be conveniently and accurately used to selectively pour flowable materials. The prior art is completely devoid of such an attachment that offers convenient, one-person operation.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An attachment is provided that may be used with a mobile platform to contain and selectively pour flowable material. An exemplary embodiment of such an attachment is provided with a bucket, having forward and rearward end portions and an inner cavity that is defined, at least in part, by front, rear, side and bottom walls, an open upper end portion and a spout portion that extends forwardly from the front wall and terminates at an upper spout lip. The spout has a long axis that extends from a lower end portion of the spout, adjacent the bottom wall of the bucket, through an upper end portion of the spout, adjacent the upper spout lip. A loader adaptor is operatively coupled with the rear wall of the bucket and is adapted to secure the attachment with the mobile platform.

In at least one preferred embodiment, first and second tabs extend upwardly from the open upper end portion of the bucket, closely adjacent opposite sides of said spout. The tabs may be positioned to direct the flowable material toward the spout as the flowable material is poured from the forward end portion of the bucket. Rear and sides splash guards may be provided to extend upwardly from an upper edge portion of the bucket. In one or more preferred embodiments, the side walls may be positioned to angle inwardly from the forward end portion of the bucket to the rearward end portion of the bucket.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Figure 1:
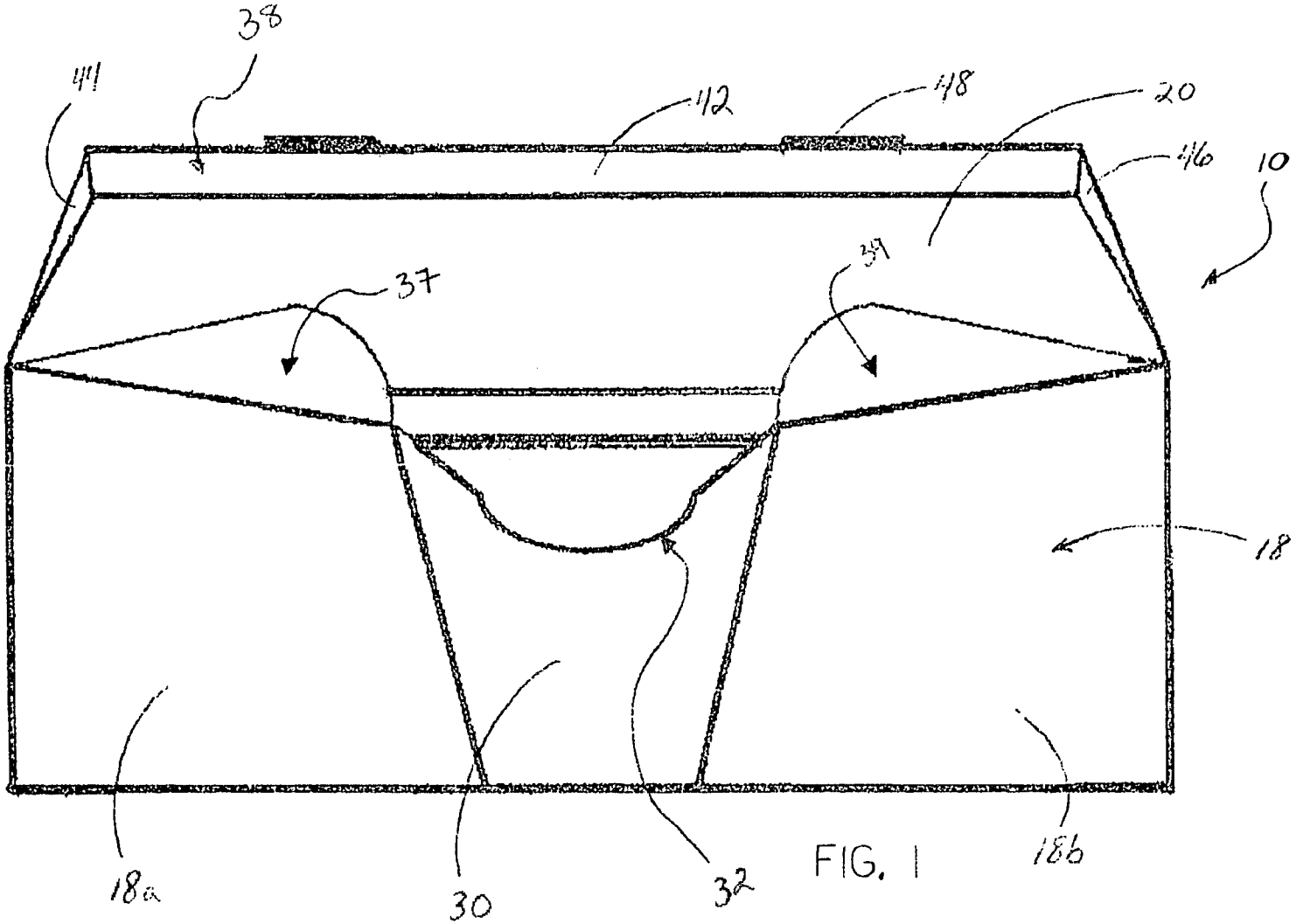
FIG. 1 is a front elevation view of one embodiment of the attachment of the present invention.
Figure 2:
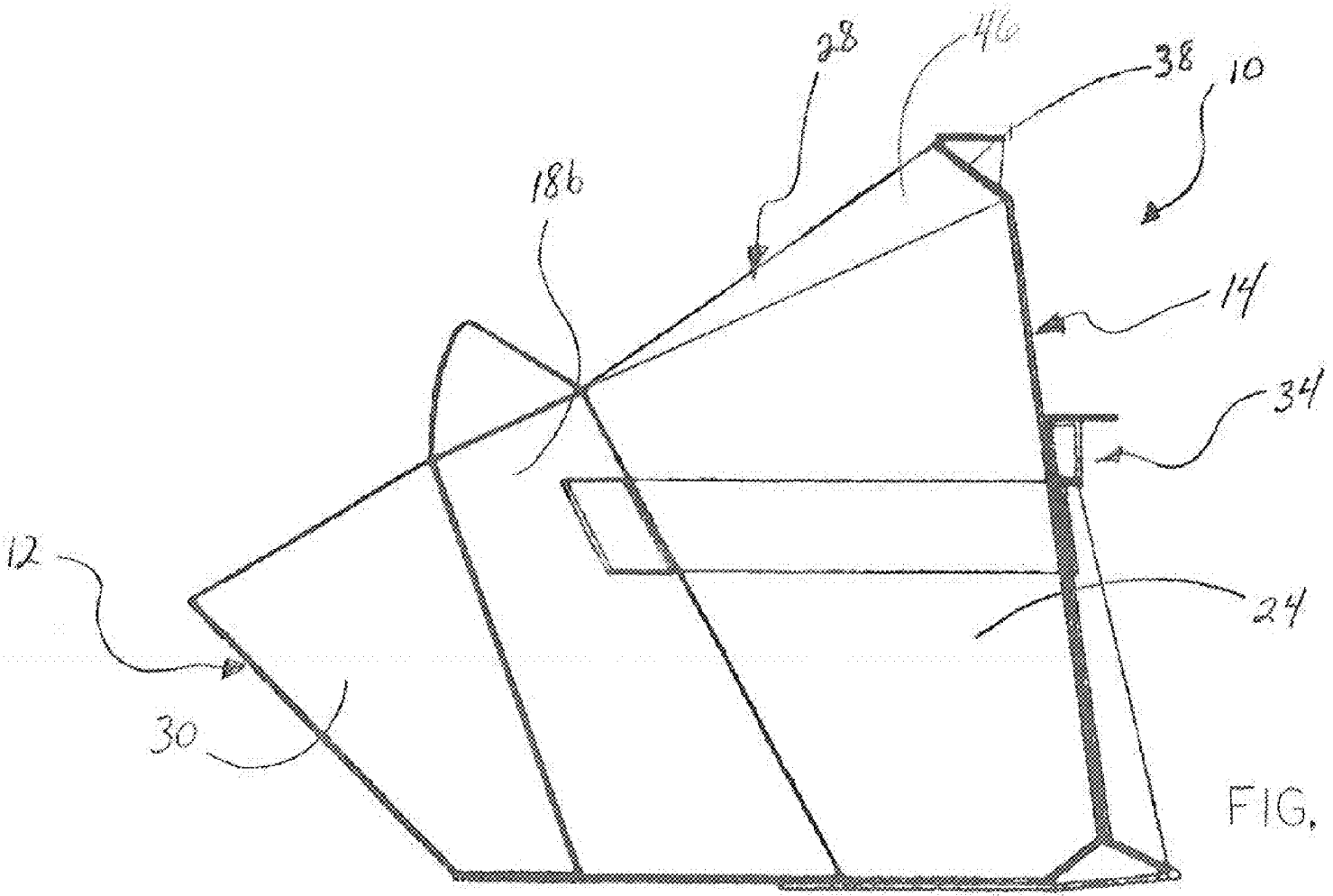
FIG. 2 is a side elevation view of the attachment depicted in FIG. 1.
Figure 3:
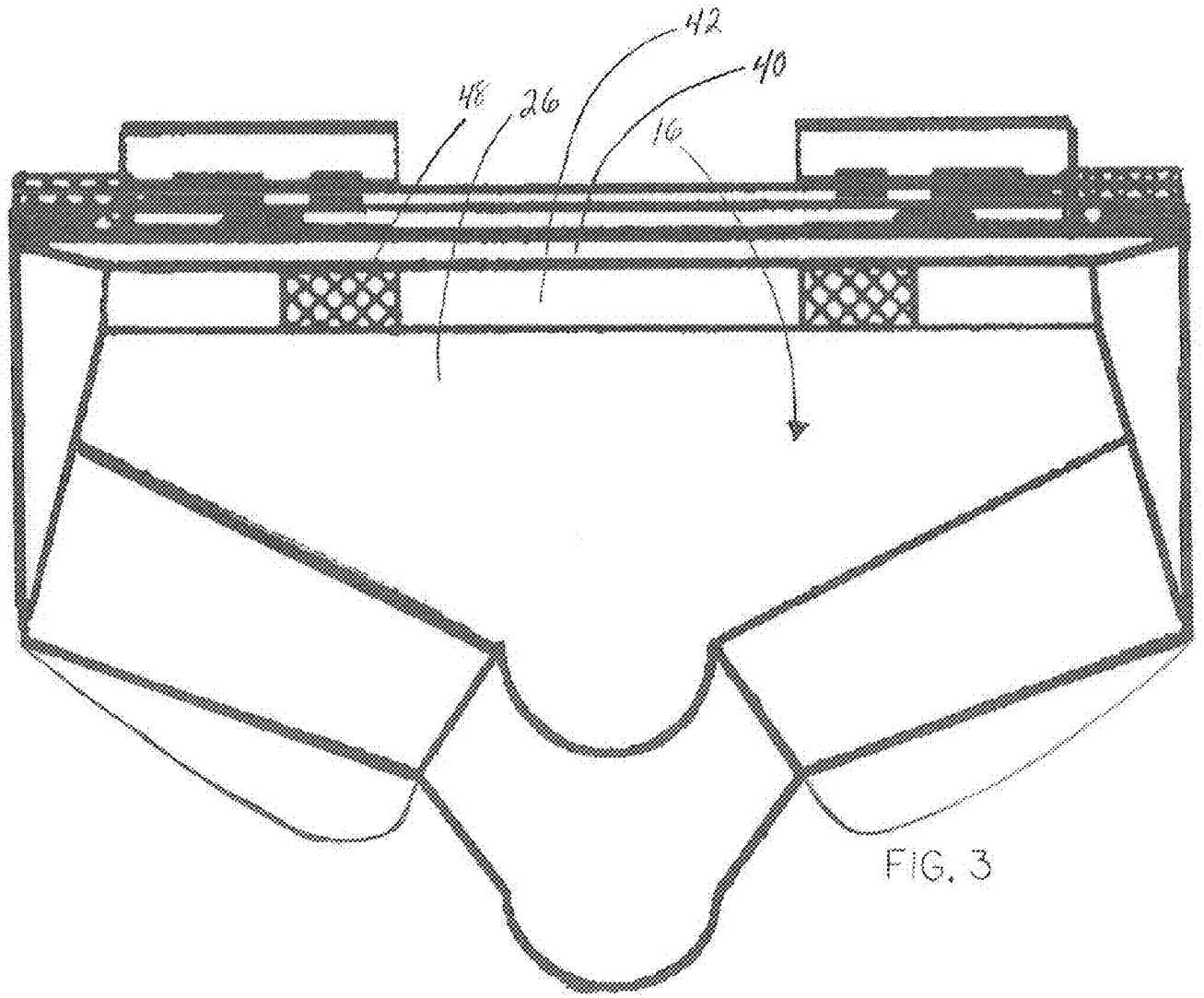
FIG. 3 is a top plan view of the attachment depicted in FIG. 1.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The attachment of the present invention is generally provided with a bucket 10 having forward end portion 12, a rearward end portion 14, and an inner cavity 16. The inner cavity 16 is defined, at least in part, by a front wall 18, rear wall 20, first side wall 22, second side wall 24, a bottom wall 26, an open upper end portion 28 and a spout portion 30 that extends forwardly from the front wall 18 and terminates at an upper spout lip 32. The spout 30 has a long axis that extends from a lower end portion of the spout, adjacent the bottom wall 26 of the bucket 10, through an upper end portion of the spout, adjacent the upper spout lip 32. The spout 30 provides directional control for pouring a flowable material, such as a liquid, concrete, small stones, sand, and similar materials, for example, from the bucket 10.

A loader adaptor 34 is preferably coupled with the rearward wall 14 to secure the attachment with a mobile platform. The loader adapter 34 may be similar to existing loader adapters, and thus the adapter 34 may utilize any existing systems, devices, or methods of adaptation for allowing a bucket attachment to couple to a wide array of mobile platforms, such as a Bobcat® quick-connect 34. Other methods of attachment, to skids for example, are contemplated. Therefore, one or more embodiments of the attachment may have substantially horizontal channels 36 for accepting skids or other supports, and such channels may be utilized in the present invention without departing from the scope or spirit of the invention. Of course, many other adaptors are known and readily apparent to those of ordinary skill in the art, and such attachments known or unknown, foreseeable and unforeseeable are incorporated within the claims.

In at least one preferred embodiment, the front wall 18 is comprised of opposite side portions 18*a* and 18*b*, positioned on either side of the spout 30.

The opposite side portions 18*a* and 18*b* are positioned to angle forwardly from forward edge portions of the first and second side walls 22 and 24, toward the spout 30. In effect, the opposite side portions help direct flowable material into the spout 30 as the bucket 10 is tipped in a forward direction. First and second tabs 37 and 39 may also be provided to extend upwardly from the open upper end portion 28 of the bucket, adjacent opposite side portions 18*a* and 18*b*. Tabs 37 and 39, as depicted in FIG. 1 are shaped and positioned to direct the flowable material toward the spout 30 and reduce the likelihood of spillage from the front end portion 12 of the bucket if the flowable material begins to shift toward the open upper end portion 28 of the bucket 10.

The spout lip 32 may be positioned to be higher than the open upper end portion 28 of the bucket 10. Such positioning will aid the accuracy with which the bucket 10 may selectively locate flowable material being poured from the inner cavity 16. In a preferred embodiment, the long axis of the spout 30 extends upwardly from the bottom wall 26 of the bucket 10, causing a portion of the bottom wall 26 to enclose the lower end portion of the spout 30. Forming the spout to extend from the bottom of the bucket 10 through the top will assist the user in pouring some materials, such as chunky concrete, as the materials are immediately directed into the spout 30 as the bucket 10 is tipped forward. Other spout designs may cause chunkier materials to collect below the spout 30 and not be evenly poured therefrom. As depicted, the spout is shaped and positioned, with respect to the remainder of the bucket 10, so that the bucket 10 must be tipped in a generally forward direction in order to pour the flowable material from the inner cavity 16 of the bucket past the upper spout lip 32 of the spout 30. This will help in preventing unintended spillage of the flowable material and is a key to enabling one-person operation of the bucket, while the user remains inside the movable platform, with ease and accuracy.

Figure 4:
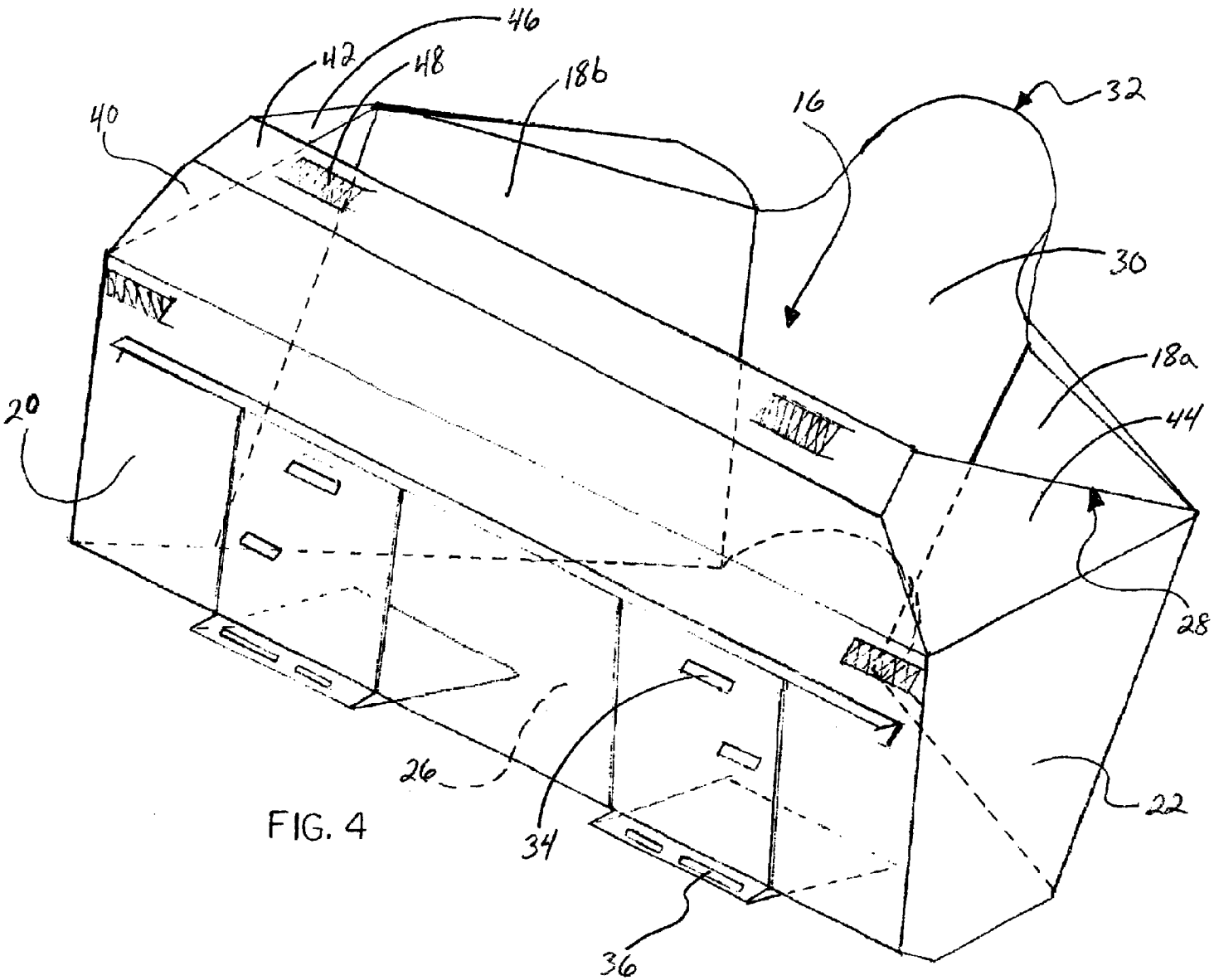
FIG. 4 is a rear isometric view of the attachment depicted in FIG. 1.

A rear splash guard 38, having a first wall 40 that extends upwardly and forwardly from an upper edge portion of the rear wall 20, may be provided to prevent flowable materials from unintentionally exiting the rearward end portion 14 of the bucket 10. In one embodiment, the rear splash guard 38 is further provided with a second wall 42 that extends outwardly from a distal edge portion of the first wall 40 so that the second wall 42 is generally parallel with the bottom wall 26 of the bucket 10. This shape will tend to direct sloshing material within the bucket 10 back toward a center portion of the inner cavity, as opposed to allowing the material to exit the bucket 10 toward the operator of the mobile platform. Similarly, first and second side splash guards 44 and 46 may be provided to extend upwardly and inwardly from upper edge portions of the first and second side walls 22 and 24. In at least one preferred embodiment, upper edge portions of the first and second side splash guards 44 and 46 are coupled with the second wall 42 of the rear splash guard 36. In addition to preventing unintentional spillage of flowable material, the splash guards may provide a user with easy access into the mobile platform. For example, FIG. 4 depicts textured step portions 48 along the second wall 42 of the rear splash guard 38. The textured step portions may be formed directly into the material used to form the splash guards or may be provided in the form of secondary structures that are adhered to the exterior surface of the splash guards using fasteners, or one of many known adhesives or welding.

In a preferred embodiment, side walls 22 and 24 are positioned to angle inwardly from the forward end portion 12 of the bucket 10 to the rearward end portion 14 of said bucket 10. In this manner, the rear corners of the bucket 10 become easier to position, thus permitting more flexibility in positioning the bucket 10 where the target area for pouring the material is restricted by walls, corners, and the like.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed is:

1. An attachment useful with a mobile platform to contain and selectively pour flowable material, the attachment comprising:

a bucket having forward and rearward end portions and an inner cavity that is defined, at least in part, by front, rear, side and bottom walls, an open upper end portion and a spout portion, having an interior volume between opposite end portions of the spout that extends forwardly from said front walls, and terminates at an upper spout lip; said front walls being angled inwardly from the side walls toward the spout, such that flowable material within the bucket is funneled into the interior volume of the spout as the bucket is tipped in a forward direction; said side walls being positioned to angle inwardly from the forward end portion of said bucket to the rearward end portion of said bucket;

said spout having a long axis that extends from a lower end portion of said spout, adjacent the bottom wall of said bucket, through an upper end portion of said spout, adjacent the upper spout lip; said long axis extending at an angle from the bottom wall of the bucket at an angle between ninety and one hundred eighty degrees;

a loader adaptor operatively coupled with said rear wall that is adapted to couple the attachment with the mobile platform.

2. The attachment of claim 1 wherein upper edge portions of the side walls reside within a single plane; a lower end portion of the spout, adjacent the bottom wall of the bucket, being positioned beneath the plane; the upper spout lip of the spout being positioned above the plane, such that the long axis of the spout passes through the plane and, when the plane is set at horizontal, the upper spout lip is positioned higher than the open upper end portion of said bucket.

3. The attachment of claim 1 wherein the long axis of said spout extends upwardly from the bottom wall of said bucket.

4. The attachment of claim 1 further comprising first and second tabs that extend upwardly from the open upper end portion of said bucket, closely adjacent opposite sides of said spout; said tabs being positioned to direct the flowable material toward said spout as the flowable material is poured from the forward end portion of said bucket.

5. The attachment of claim 1 further comprising a rear splash guard having a first wall that extends upwardly and forwardly from an upper edge portion of said rear wall.

6. The attachment of claim 5 wherein said rear splash guard is further comprised of a second wall that extends outwardly from a distal edge portion of the first wall of said rear splash guard so that said second wall is generally parallel with the bottom wall of said bucket.

7. The attachment of claim 6 further comprising first and second side splash guards; each extending upwardly and inwardly from upper edge portions of said side walls.

8. The attachment of claim 6 wherein the second wall of said rear splash guard is provided with at least one textured step portion that is positioned to provide a user with a convenient way of using said bucket to climb into the mobile platform.

9. The attachment of claim 2 wherein said spout is shaped and positioned so that said bucket must be tipped in a forward direction in order to pour the flowable material from the inner cavity of said bucket past the upper spout lip of said spout.

10. The attachment of claim 3 further comprising first and second tabs that extend upwardly from the open upper end portion of said bucket, closely adjacent opposite sides of said spout; said tabs being positioned to direct the flowable material toward said spout as the flowable material is poured from the forward end portion of said bucket.

11. The attachment of claim 10 further comprising a rear splash guard having a first wall, which extends upwardly and forwardly from an upper edge portion of said rear wall, and a second wall that extends outwardly from a distal edge portion of the first wall of said rear splash guard so that said second wall is generally parallel with the bottom wall of said bucket.

12. The attachment of claim 11 further comprising first and second side splash guards, each extending upwardly and inwardly from upper edge portions of said side walls and upper edge portions of said first and second side splash guards are coupled with the second wall of said rear splash guard.

13. An attachment useful with a mobile platform to contain and selectively pour flowable material, the attachment comprising:

a bucket having forward and rearward end portions and an inner cavity that is defined, at least in part, by front, rear, side and bottom walls, an open upper end portion and a spout portion, having an interior volume between opposite end portions of the spout that extends forwardly from said front walls, and terminates at an upper spout lip; said front walls being angled inwardly from the side walls toward the spout, such that flowable material within the bucket is funneled into the interior volume of the spout as the bucket is tipped in a forward direction; said side walls being positioned to angle inwardly from the forward end portion of said bucket to the rearward end portion of said bucket;

first and second tabs that extend upwardly from the open upper end portion of said bucket, closely adjacent opposite sides of said spout; said tabs being positioned to direct the flowable material toward said spout as the flowable material is poured from the forward end portion of said bucket:

a rear splash guard having a first wall, which extends upwardly and forwardly from an upper edge portion of said rear wall, and a second wall that extends outwardly from a distal edge portion of the first wall of said rear splash guard so that said second wall is generally parallel with the bottom wall of said bucket;

first and second side splash guards, each extending upwardly and inwardly from upper edge portions of said side walls and upper edge portions of said first and second side splash guards are coupled with the second wall of said rear splash guard;

said spout having a long axis that upwardly extends from the bottom wall of said bucket, through an upper end portion of said spout, adjacent the upper spout lip; said long axis extending at an angle from the bottom wall of the bucket at an angle between ninety and one hundred eighty degrees:

a loader adaptor operatively coupled with said rear wall that is adapted to couple the attachment with the mobile platform.

14. The attachment of claim 1 wherein the front wall of said bucket is comprised of opposite side portions, positioned on either side of said spout; said opposite side portions being positioned to angle forwardly from forward edge potions of said side walls toward said spout.

15. The attachment of claim 1 wherein the skid adaptor system has a first brace and a second brace, each of the first brace and the second brace being shaped and sized to releasably receive a skid extending from the mobile platform.

16. An attachment useful with a mobile platform to contain and selectively pour fiowable material, the attachment comprising:

a bucket having forward and rearward end portions and an inner cavity that is defined, at least in part, by front, rear, side and bottom walls, an open upper end portion and a spout portion, having an interior volume between opposite end portions of the spout that extends forwardly from said front walls, and terminates at an upper spout lip; said front walls being angled inwardly from the side walls toward the spout, such that flowable material within the bucket is funneled into the interior volume of the spout as the bucket is tipped in a forward direction; upper edge portions of the side walls reside within a single plane; a lower end portion of the spout, adjacent the bottom wall of the bucket, being positioned beneath the plane; the upper spout lip of the spout being positioned above the plane, such that the long axis of the spout passes through the plane and, when the plane is set at horizontal, the upper spout lip is positioned higher than the open upper end portion of said bucket; said side walls are positioned to angle inwardly from the forward end portion of said bucket to the rearward end portion of said bucket;

said spout having a long axis that extends from a lower end portion of said spout, adjacent the bottom wall of said bucket, through an upper end portion of said spout, adjacent the upper spout lip; said long axis extending at an angle from the bottom wall of the bucket at an angle between ninety and one hundred eighty degrees;

first and second tabs that extend upwardly from the open upper end portion of said bucket, closely adjacent opposite sides of said spout: said tabs being positioned to direct the flowable material toward said spout as the flowable material is poured from the forward end portion of said bucket; and a loader adaptor operatively coupled with said rear wall that is adapted to couple the attachment with the mobile platform.

17. The attachment of claim 16 further comprising:

a rear splash guard having a first wall, which extends upwardly and forwardly from an upper edge portion of said rear wall, and a second wall that extends outwardly from a distal edge portion of the first wall of said rear splash guard so that said second wall is generally parallel with the bottom wall of said bucket; and first and second side splash guards, each extending upwardly and inwardly from upper edge portions of said side walls and upper edge portions of said first and second side splash guards are coupled with the second wall of said rear splash guard.

* * * * *